US005790683A

United States Patent [19]

Salzani

[11] Patent Number: 5,790,683

[45] Date of Patent: Aug. 4, 1998

[54] HEADPHONE INCLUDING SPLIT EARPHONES AND COUPLING MEANS FOR COUPLING IT TO THE EARS

[76] Inventor: Augusto Salzani, Vicolo S. Martino, 21, 20092 Cusano, Milano, Italy

[21] Appl. No.: 931,173

[22] Filed: Sep. 16, 1997

Related U.S. Application Data

[63] Continuation-in-part of Ser. No. 488,167, Jun. 12, 1995.

[30] Foreign Application Priority Data

Jun. 17, 1994 [IT] Italy ..... MI940446 U

[51] Int. Cl.[6] ..... H04R 25/00

[52] U.S. Cl. ..... 381/183; 381/187

[58] Field of Search ..... 381/25, 68.7, 183, 381/187, 188, 205; 379/430, 426, 431, 446; 181/129, 130, 135; 29/594

[56] References Cited

U.S. PATENT DOCUMENTS

| | | | |
|---|---|---|---|
| 2,474,135 | 6/1949 | White | 381/187 |
| 3,306,991 | 2/1967 | Wood . | |
| 3,667,569 | 6/1972 | Mackey et al. | 381/187 |
| 3,851,123 | 11/1974 | Lipinski et al. | 381/183 |
| 3,862,378 | 1/1975 | Norris | 379/430 |
| 4,453,050 | 6/1984 | Enokido | 381/187 |
| 4,529,058 | 7/1985 | Emery | 381/187 |
| 4,658,931 | 4/1987 | Curry | 181/129 |
| 4,702,345 | 10/1987 | Jannsen et al. | 381/68.7 |
| 4,741,030 | 4/1988 | Wilson | 379/430 |
| 4,958,697 | 9/1990 | Moody | 381/183 |
| 5,020,163 | 6/1991 | Aileo et al. | 381/183 |
| 5,148,887 | 9/1992 | Murphy | 381/187 |
| 5,210,792 | 5/1993 | Kajihara | 381/187 |
| 5,412,736 | 5/1995 | Keliiliki | 381/68.7 |
| 5,450,496 | 9/1995 | Burris et al. | 381/183 |
| 5,459,290 | 10/1995 | Yamigishi | 381/183 |
| 5,625,171 | 4/1997 | Marshall | 381/187 |
| 5,655,026 | 8/1997 | Peters et al. | 381/187 |
| 5,729,615 | 3/1998 | Yang | 381/183 |

FOREIGN PATENT DOCUMENTS

| | | | |
|---|---|---|---|
| 4-96554 | 3/1992 | Japan | 379/430 |

*Primary Examiner*—Paul Loomis
*Assistant Examiner*—Rexford N. Barnie
*Attorney, Agent, or Firm*—Bucknam and Archer

[57] ABSTRACT

The present invention relates to an acoustic headphone of the split earphone type, which is connected to the ears by providing, for each earphone, a soft material cushion element which can be coupled to the ear pavilion and is supported by a bridging element articulated with an insert portion of a curved element made of a comparatively soft material and which is coupled to the rear face of the rear pavilion.

6 Claims, 5 Drawing Sheets

HEADPHONE INCLUDING SPLIT EARPHONES AND COUPLING MEANS FOR COUPLING IT TO THE EARS

BACKGROUND OF THE INVENTION

The present invention, which is a Continuation-in-Part of the U.S. patent application Ser. No. 08/488,167 filed on Jun. 12, 1995 in the name of the same Applicant, relates to an acoustic headphone of the split earphone type, including specifically designed clamping means for coupling the headphone to the ears of an user.

As is known, prior commercially available headphones usually comprise a pair of earphones, coupled to one another by a resilient curved element allowing to provide a small pressure for coupling the earphones to the ears of an user.

Such an arrangement has, at first, the drawback that it is rather discomfortable since the coupling element engaging at the rear of an user head or possibly passing under the chin of the user, represents frequently an obstruction, and the pressing exerted on the ear pavilion can be dangerous for the user.

Other prior arrangements, including split-earphone headset constructions, provide to make the earphones so as to be adapted to be directly introduced into the ear pavilion, thereby providing discomfort to the user.

Prior systems for connecting the earphones to the ears, and conventionally using clips or the like elements, have not encountered a satisfactory success, since they comprise comparatively stiff coupling elements provided for directly contacting the ear pavilion.

The U.S. Pat. No. 4,453,050 to Enokido discloses an headphone substantially comprising three parts, two of which are hinged in a fixed relative position and the third of which is slidable with respect to the other two. In particular, in this document, the headphone housing must be adapted to the ears of the user by sliding a bridging element along a rod.

This prior headphone further includes a cushion element which covers only a central portion of the external face of the ear pavilion, as well as a C-shape element engaging the auricle in a manner similar to a lens frame.

SUMMARY OF THE INVENTION

Accordingly, the aim of the present invention is to overcome the above mentioned drawbacks, by providing a split-earphone headset or headphone including clamping means for quickly and easily coupling it to the ears of an user, which allows the split earphones to be coupled to the ears in a very comfortable manner.

Within the scope of the above mentioned aim, a main object of the present invention is to provide such a headphone in which the split earphones thereof can be practically clamped to the ear pavilions so as to provide a firm connection which is on the other hand very comfortable for the user.

Another object of the present invention is to provide such a headphone which is very safe and reliable in operation, can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a split-earphone headphone, including means for clamping it to the ears of an user, characterized in that said headphone comprises, for each earphone thereof, a cup-like shaped cushion element made of a soft material, which can be coupled to the ear pavilion of an user and being supported by a first clamping element articulated with a closed-end C-shape designed insert portion of a second clamping element, made of a comparatively soft material and which can be coupled to the rear face of the ear pavilion.

BRIEF DESCRIPTION OF THE DRAWINGS

Further characteristics and advantages of the invention will become more apparent hereinafter from the following detailed disclosure of two preferred, though not exclusive, embodiments of the acoustic headphone according to the present invention which are illustrated, by way of a merely indicative, but not limitative, example, in the figures of the accompanying drawings, where:

FIG. 1 is a perspective view of the subject headphone as applied to the ears of an user;

FIG. 2 is a further perspective view illustrating an earphone associated with the headphone according to the invention;

FIG. 3 is an exploded perspective view illustrating an earphone;

FIG. 4 illustrates a detail of the articulation region between the first clamping element an a closed-end C-shape designed insert portion;

FIG. 5 is a cross-sectional view illustrating an earphone in a closed condition thereof;

FIG. 6 is a further cross-sectional view illustrating the earphone in a slightly spread-apart condition, in order to allow it to be easily applied to the ear pavilion;

FIG. 7 is a perspective view illustrating an earphone;

FIG. 8 is an exploded perspective view illustrating an earphone;

FIG. 9 is a front elevation view illustrating the first clamping element;

FIG. 10 is a top plan view illustrating the first clamping element;

FIG. 11 is a rear elevation view illustrating the first clamping element;

FIG. 12 is a cross sectional view of FIG. 11, substantially taken along the section line XII—XII;

FIG. 13 illustrates, on an enlarged scale, a detail of FIG. 12;

FIG. 14 is a front elevation view illustrating the closed-end C-shape designed insert portion of the second clamping element;

FIG. 15 is a further elevation view illustrating the insert portion of the second clamping element;

FIG. 16 is a further elevation view illustrating the first clamping element coupled to the insert portion of the second clamping element, in the closure condition thereof; and FIG. 17 illustrates the first clamping element coupled to the insert portion of the second clamping element in an opened position thereof.

DESCRIPTION OF THE PREFERRED EMBODIMENTS

Figure 6:
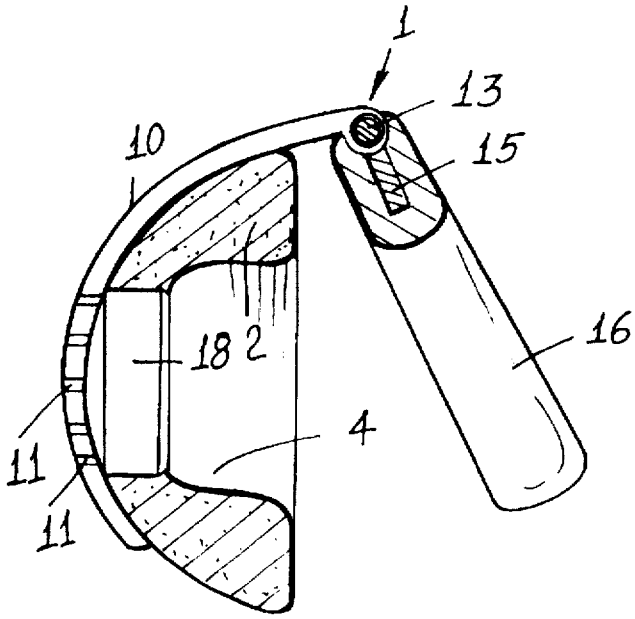
FIGS. 1 to 6 illustrate a first embodiment of the headphone according to the present invention and, more specifically.
Figure 5:
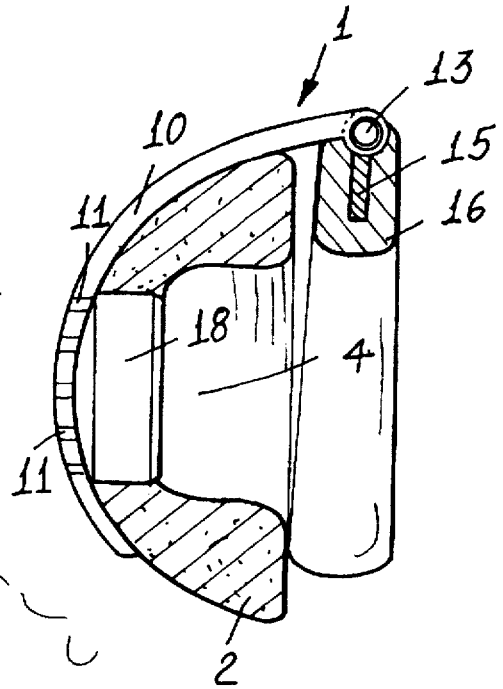
Figure 1:
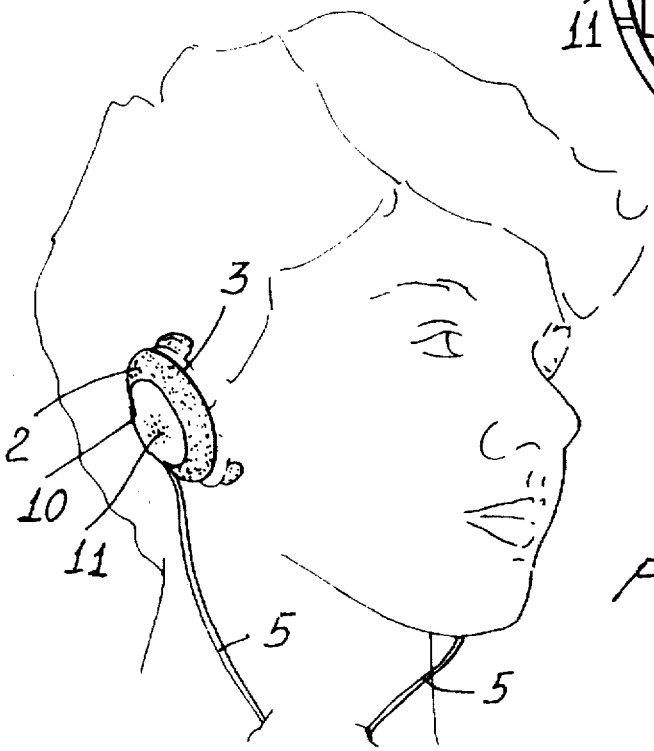
Figure 3:
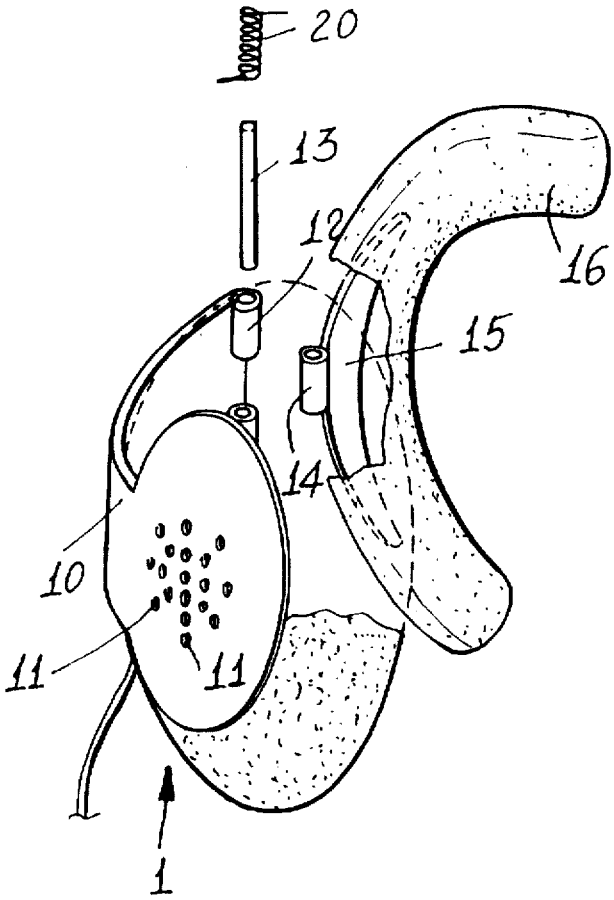
Figure 2:
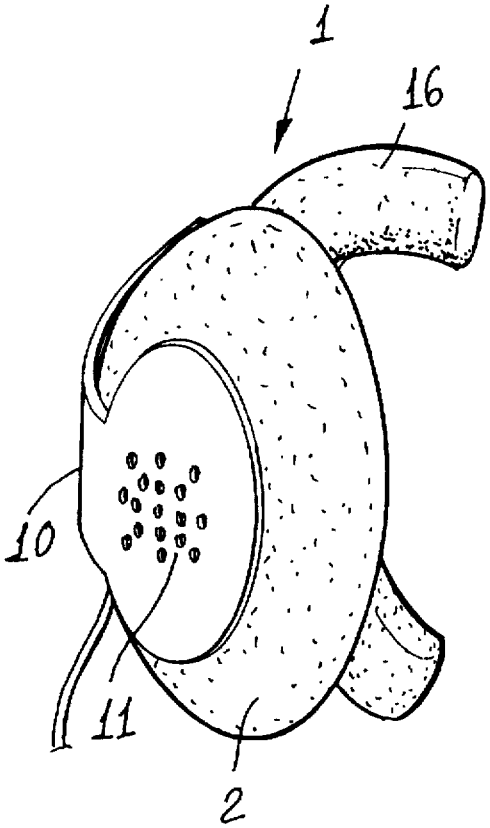
Figure 4:
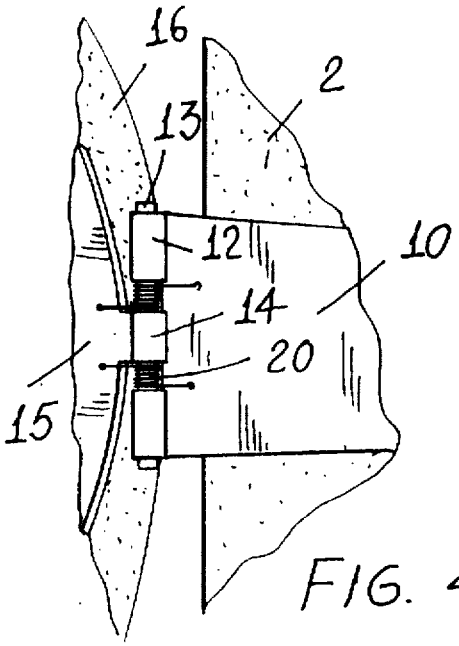
Figure 7:
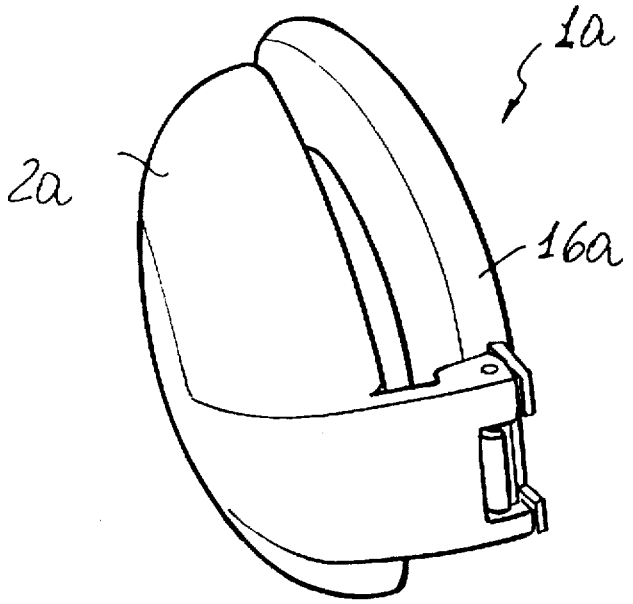
FIGS. 7 to 17 illustrates a second embodiment of the headphone according to the present invention and, more specifically.
Figure 8:
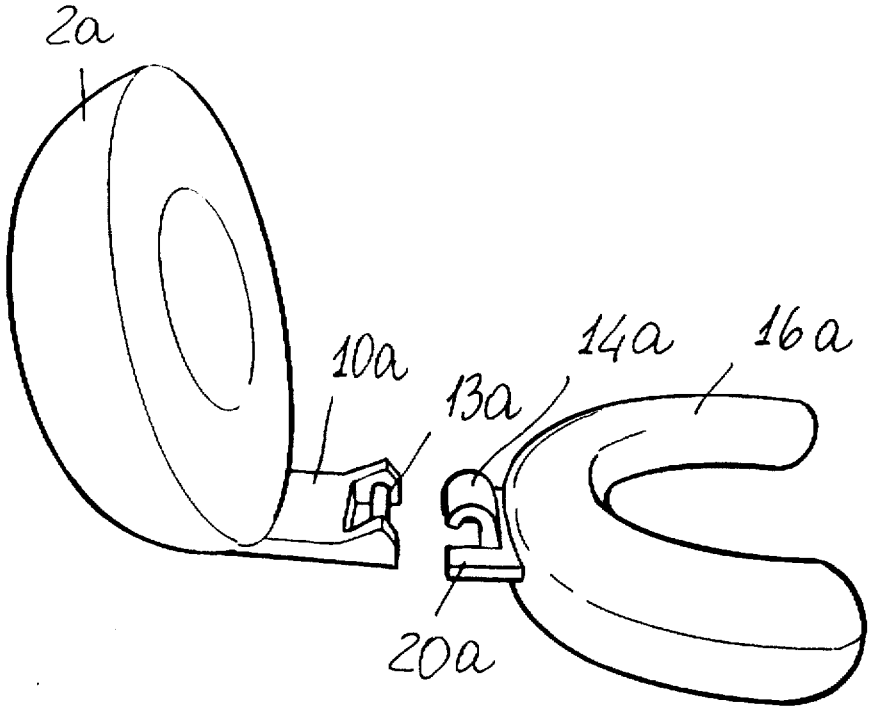
Figure 9:
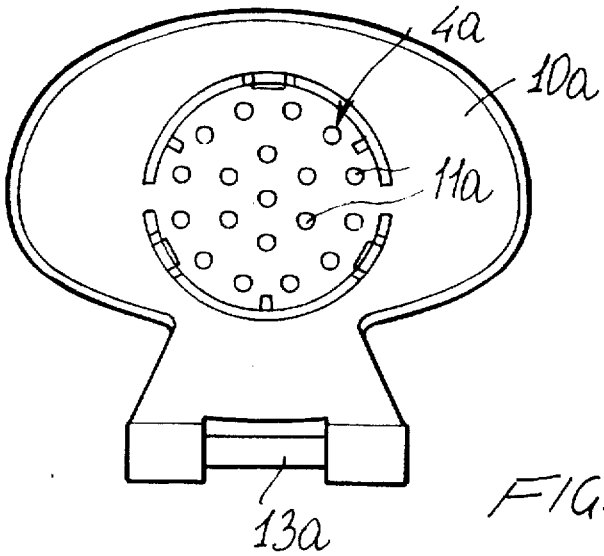
Figure 13:
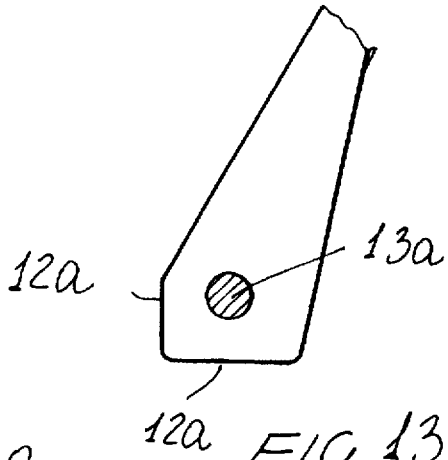
Figure 10:
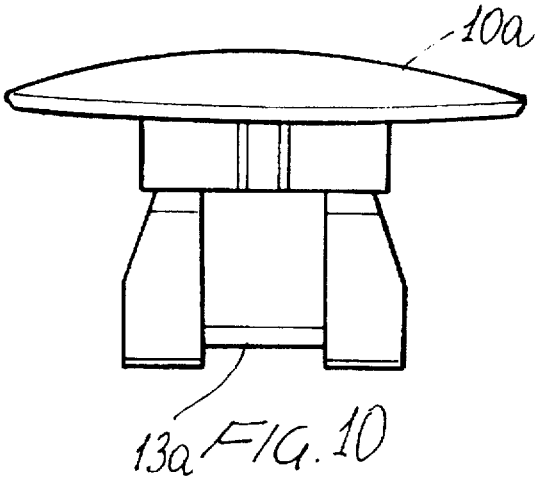
Figure 12:
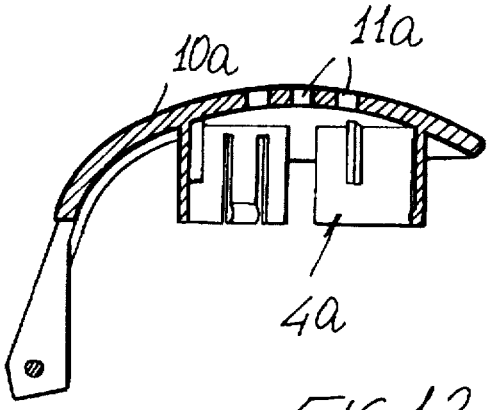
Figure 11:
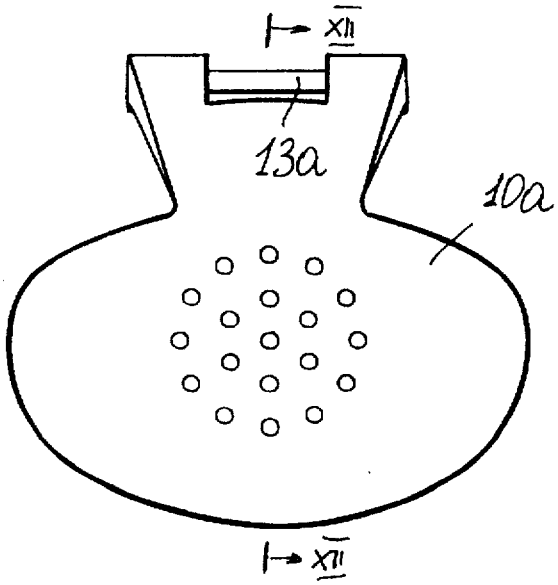

With reference to the number references of FIGS. 1 to 6, the split-earphone acoustic headphone according to the present invention, provided with means for quickly and easily coupling it to the ears of an users comprises, for each earphone, indicated generally by the reference number 1, a cup-like cushion element 2 which covers the entire surface of the external ear pavilion, as shown in FIG. 1, and made of a soft material, advantageously a foamed plyurethane material, provided for bearing against the ear pavilion 3.

The cushion element 2 is provided, in its inside, with a cavity 4 into which can be introduced the conventional microphone 18, which is coupled, through a wire 5 to a playback appliance.

The cushion element 2 is supported by a first clamping element 10, preferably made of a stiff plastic material, which, at the microphone application region, is provided with a plurality of throughgoing holes 11.

At one end portion thereof, the clamping element 10 is provided with hinge means 12 which, through a pivot-pin 13, are articulated with corresponding hinge means 14, comprising a closed-end C-shape designed insert portion 15 arranged inside a second clamping element 16.

The second clamping element 16, which has a substantially C-shape, is made of a foamed polyurethane material, and has preferably a softness less than that of the cushion element 2.

The second clamping element 16, in particular, can be coupled to the rear face of the ear pavilion.

In order to provide a firm coupling of the earphone to the ear pavilion, at said hinge means are provided resilient return means 20, advantageously comprising a pin spring 11, or flexure spring, which resiliently connects to one another the second clamping element 16 and cushion element 2, by sweetly clamping them on the rear pavilion.

Thus, the user will have the earphone clamped to his/her ear, with an interposition of a soft material on all of the bearing regions, and with a clamping pressure which is very sweet and accordingly not dangerous, but adapted to provide a firm support for the earphone.

As shown, the cushion element 2 is moreover provided with an inside cavity 4, into which can be introduced a microphone 18, and, more specifically, a "horn" or trumpet microphone.

Such a configuration will allow to faithfully reproduce the "bass" tones which can be hardly reproduced by prior acoustical headphones.

FIGS. 7 to 17 illustrate a second embodiment of the split-earphone headphone according to the present invention.

In this second embodiment too, each earphone, generally indicated by the reference number 1*a*, comprises a cushion element 2*a*, of a soft material, having an inside cavity 4*a* into which can be introduced the microphone to be coupled to the playback appliance.

The cushion element 2*a* is supported by a first clamping element 10*a* which is also preferably made of a rigid plastic material and being provided, at the microphone application region thereof, with a plurality of throughgoing holes 11*a*.

At one end portion thereof, the first clamping element 10*a* is articulated to an insert portion 15*a* arranged inside a curved element 16*a*. The second clamping element 16*a* is also made of a foamed polyurethane material and is preferably provided with a softness less than that of the cushion element 2*a*.

The articulated connection between the first clamping element 10*a* and insert portion 15*a* is obtained by a pivot-pin 13*a* which is rigidly connected to the first clamping element 10*a* and with which a second clamping portion 14*a* of the insert 15*a* is rotatively connected. The curved portion 14*a* is suitably opened, so as to allow the first clamping element to be quickly assembled to the insert 15*a*.

In this second embodiment, the resilient means holding the first clamping element 10*a* in the closure condition thereof with respect to the insert 15*a*, or in the opening condition thereof, comprise a pair of cam elements 12*a* extending about the axis of the pivot-pin 13*a* in those regions of the first clamping element 10*a* which are arranged at the end portions of said pivot-pin 13*a*. The cam elements 12*a* bear against wings or legs 20*a* laterally arranged on opposite portions of the curved part 14*a* of the insert 15*a*.

Thus, the legs 20*a* will operate like the spring 20 of the first embodiment, with the advantage that the cam elements 12*a* will allow to firmly hold each earphone in its opened or closed position, thereby facilitating the fitting of the earphone to the ear.

From the above disclosure it should be apparent that the invention fully achieves the intended aim and objects.

Figure 14:
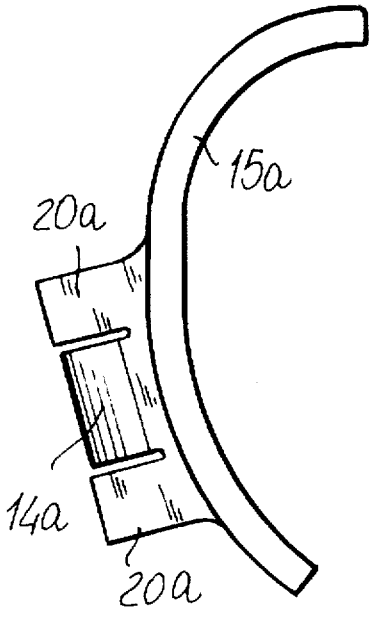
Figure 15:
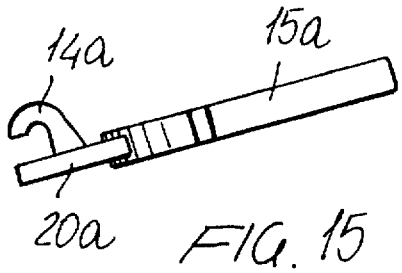
Figure 16:
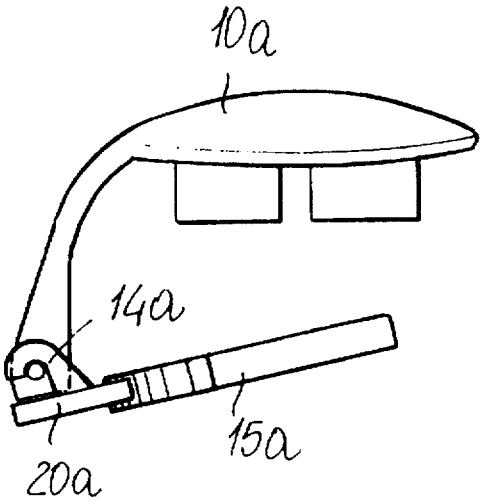
Figure 17:
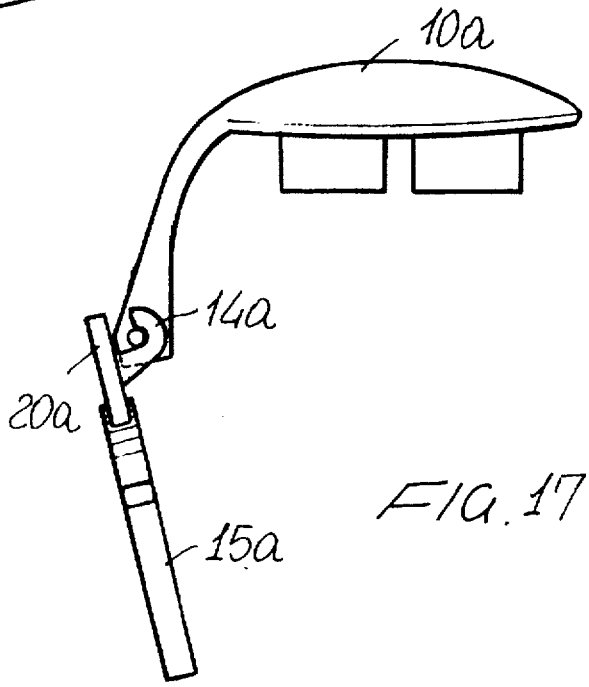

In particular, a headphone has been disclosed which, differently from the prior headphone disclosed by the above U.S. Patent to Enokido, does not require any adjustment in order to fit the ear pavilions; moreover Applicant's closed-end C-shape second clamping element (16), owing to the hinging connection 12, 13, provided with the resilient means 20 operating at the point region between the clamping element 10 and the insert portion 15, provides a clamping action and a firm coupling to the ears, which is obtained by its closed-end C-shape designed for surrounding the internal face of the auricle, as is clearly shown in FIG. 14.

Furthermore, Applicant's headphone, as stated, comprises only two clamping parts 50, hinged as to assume a fixed relative position (FIGS. 3, 4, 7, 8) and which allow Applicant's headphone to suitably fit any size and shape of user's ears.

In particular, the combination of the closed-end C-shape clamping element 16 and cup-like cushion element 2 provides a better acoustic performance of the headphone, due to the better isolation from environmental noises and a better adhesion of the clamping elements to the ears; furthermore, the horn shaped cavity 4 provides a better reproduction of bass tones.

Finally, the provision of the throughgoing holes 11 in the first clamping element 10 at the region of the cavity 4*a* will improve the response of the transducer 18 by equilibrating the pressure inside said second cavity 4 with the atmospheric pressure.

I claim:

1. A split-earphone headphone comprising, in combination:

a soft cup-like cushion element; a soft material closed C-shape insert portion element which can be clamped to auricles; said soft cup-like cushion element covering an entire surface of an external ear pavilion and being supported by a first clamping element having a first end and a second end, said soft material closed C-shape insert portion element operating as a second clamping element; connecting means operating at a region between said first clamping element and said second clamping element for connecting said first end of said first clamping element to said second clamping element by a hinge joint provided with resilient means for firmly clamping an ear, said second end of said clamping element housing a microphone therein, said soft cup-like cushion element being provided with a horn shaped cavity for housing therein said microphone, said first clamping element being provided with a plurality of throughgoing holes at a region thereof for coupling with said microphone.

2. A headphone, according to claim 1, wherein said soft cup-like cushion element is made of a soft foamed polyurethane material.

3. A headphone, according to claim 1, wherein said second clamping element has a closed-end C-shape and is made of a foamed polyurethane having a softness less than that of the material forming said soft cup-like cushion element.

4. A headphone, according to claim 1, wherein said resilient means comprise a flexure spring operating between an articulation portion provided on said first clamping element and an articulation portion provided on said insert portion.

5. A headphone, according to claim 1, wherein said resilient means comprise at least a resiliently flexible leg associated with said insert portion and engaging with a cam element rigid with said first clamping elements.

6. A headphone, according to claim 1, wherein said first clamping element is hinge connected to said insert portion by a pivot-pin rigid with said first clamping element and a clamping portion of opened configuration rigid with said insert portion of said second clamping element rotatably engaging with said pivot-pin.

* * * * *